US010779668B2

(12) United States Patent
Erickson

(10) Patent No.: US 10,779,668 B2
(45) Date of Patent: Sep. 22, 2020

(54) COLLAPSIBLE HAT RACK

(71) Applicant: Dennis Erickson, Brownsville, VT (US)

(72) Inventor: Dennis Erickson, Brownsville, VT (US)

( * ) Notice: Subject to any disclaimer, the term of this patent is extended or adjusted under 35 U.S.C. 154(b) by 0 days.

(21) Appl. No.: 14/190,922

(22) Filed: Feb. 26, 2014

(65) Prior Publication Data

US 2014/0263110 A1 Sep. 18, 2014

Related U.S. Application Data

(60) Provisional application No. 61/798,792, filed on Mar. 15, 2013.

(51) Int. Cl.

*A47G 25/00* (2006.01)
*A47G 25/10* (2006.01)
*A47G 25/74* (2006.01)

(52) U.S. Cl.

CPC ..... *A47G 25/10* (2013.01); *A47G 25/746* (2013.01)

(58) Field of Classification Search

CPC ..... A47G 25/0685; A47G 25/746; A47G 25/0614; A47G 25/48; A47G 25/10; A47G 25/18; A47G 25/483; D06F 57/12; D06F 57/08

USPC ..... 211/32, 31, 30, 89.01, 96, 85.3, 13.1, 211/87.01, 118, 119.13, 124

See application file for complete search history.

(56) References Cited

U.S. PATENT DOCUMENTS 426,313 A * 4/1890 Paxson ..... 211/99
620,638 A * 3/1899 Boucher ..... 211/99
918,196 A * 4/1909 Price ..... A47F 7/163 211/45
971,493 A * 9/1910 Crane ..... 211/99
978,423 A * 12/1910 Zizinia ..... 211/99
2,271,941 A * 2/1942 Kemmitt ..... A47B 61/003 211/113
2,561,728 A * 7/1951 Dolan ..... 211/89.01
2,577,397 A * 12/1951 Bailey ..... A47G 25/18 211/104
2,675,130 A * 4/1954 Dore ..... A47G 25/18 211/118
2,948,406 A * 8/1960 Steele ..... 211/99
2,987,193 A * 6/1961 Pajor ..... 211/89.01
3,178,033 A * 4/1965 Wirsing ..... A47K 10/14 211/119.009
3,211,295 A * 10/1965 Weiss ..... 211/100

(Continued)

*Primary Examiner* — Kimberley S Wright
(74) *Attorney, Agent, or Firm* — Mintz Levin Cohn Gerris Glovsky and Popeo, P.C.; Steven M. Jensen

(57) ABSTRACT

Disclosed is a collapsible hat rack for efficiently and neatly storing a plurality of hats. In particular, the collapsible hat rack may be made up of a base unit, a pivotable arm, a plurality of rungs, and a stopping mechanism. More specifically, the base unit may be mounted on a surface such as a wall or door; and a pivotable frame may be hingedly mounted to a bottom portion of the base unit. Hats may be clamped between pivotable clamping mechanisms that are attached to each of a plurality of rungs disposed between side portions of the pivotable frame. When a top portion of the pivotable frame is rotated away from the top portion of the base unit, the pivotable frame is rotated about an axis at the bottom of the base unit until a stopping mechanism suspends the pivotable frame at a predetermined angle from the base unit.

20 Claims, 5 Drawing Sheets

(56) References Cited

U.S. PATENT DOCUMENTS

| | | | | | |
|---|---|---|---|---|---|
| 5,019,126 | A * | 5/1991 | Post | 211/104 | |
| 5,075,935 | A * | 12/1991 | Abdi | A47G 25/32 | 24/500 |
| 5,515,978 | A * | 5/1996 | Moran | A47G 25/10 | 211/113 |
| 5,645,178 | A * | 7/1997 | Conley, Jr. | A47F 5/08 | 211/87.01 |
| 5,890,638 | A * | 4/1999 | Woloshen | A45F 5/02 | 224/191 |
| 6,863,196 | B1 * | 3/2005 | Carter et al. | 223/85 | |
| 8,602,228 | B1 * | 12/2013 | Martinez | 211/100 | |
| 9,402,493 | B2 * | 8/2016 | McAmis | D06F 57/12 | |
| 10,506,877 | B1 * | 12/2019 | Edwards, II | A47B 61/02 | |
| 2009/0250417 | A1 * | 10/2009 | McNiff | A47G 25/746 | 211/85.3 |
| 2016/0178280 | A1 * | 6/2016 | McAmis | A47B 61/02 | 211/123 |

* cited by examiner

COLLAPSIBLE HAT RACK

CROSS REFERENCE TO RELATED APPLICATIONS

This application claims the benefit of U.S. Provisional Patent Application Ser. No. 61/798,792, filed Mar. 15, 2013, the entire contents of which are incorporated herein by reference.

BACKGROUND

Field of the Invention

The present invention relates to a collapsible hat rack for storing a plurality of hats.

Description of the Related Art

For many people, hat storage is increasing problematic especially in today's society where homes are becoming more compact. Since homes are becoming more compact, organization has become a key component in household efficiency and use. One well known storage solution for hats is a hat rack. Hat racks have been used for centuries as a free standing structure that stands on the floor of one's home. However, in smaller homes there is often no place for hat racks, since floor space and living space is limited.

As a result, some individuals hang their hats on fixed hooks on the wall to reduce the amount of floor space occupied by a hat racks. However, typically, since each hook can efficiently and neatly hold no more than one hat, the wall space often becomes cluttered and unsightly. Similarly, storing hats on shelves is untidy and an inefficient use of space. Many loyal baseball fans collect various baseball caps, and have a tendency to leave them strewn about. Thus, there is a need for an efficient hat storage solution which is capable of neatly storing a plurality of hats while at the same time taking up the smallest amount of space possible.

SUMMARY

The present invention relates to a collapsible hat rack for efficiently and neatly storing a plurality of hats in a confined location. In particular, the collapsible hat rack may be made up of a base unit, a pivotable arm, a plurality of rungs, and a stopping mechanism. More specifically, the base unit may be mounted on a surface such as a wall or door; and a pivotable frame may be hingedly mounted to a bottom portion of the base unit. Hats may be clamped between pivotable clamping mechanisms that are attached to each of a plurality of rungs disposed between side portions of the pivotable frame. When a top portion of the pivotable frame is rotated away from the top portion of the base unit, the pivotable frame is rotated about an axis at the bottom of the base unit until a stopping mechanism suspends the pivotable frame at an predetermined angle from the base unit.

Advantageously, a plurality of hats may be clamped between each clamping end of each clamping mechanism so that when the collapsible hat rack of the exemplary embodiment of the present invention is in the opened position, the hats can be easily seen and identified by the user. When the collapsible hat rack is fully collapsed/closed, the hats are rotated in the direction of gravity and efficiently folded together one on top of the other to form a compact row of hats that are neatly folded one on top of the other.

It is to be understood that both the foregoing general description and the following detailed description are exemplary and explanatory only and are intended to provide further explanation of the present invention, as claimed.

DETAILED DESCRIPTION

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

The present invention relates to a collapsible hat rack for efficiently and neatly storing a plurality of hats in a confined location. In particular, the collapsible hat rack may be made up of a base unit, a pivotable arm, a plurality of rungs, and a stopping mechanism. More specifically, the base unit may be mounted on a wall; and a pivotable frame may be hingedly mounted to a bottom portion of the base unit. Hats may be clamped between pivotable clamping mechanisms that are attached to each of a plurality of rungs disposed between side portions of the pivotable frame. When a top portion of the pivotable frame is rotated away from the top portion of the base unit, the pivotable frame is rotated about an axis at the bottom of the base unit until a stopping mechanism suspends the pivotable frame at an predetermined angle from the base unit.

Figure 1:
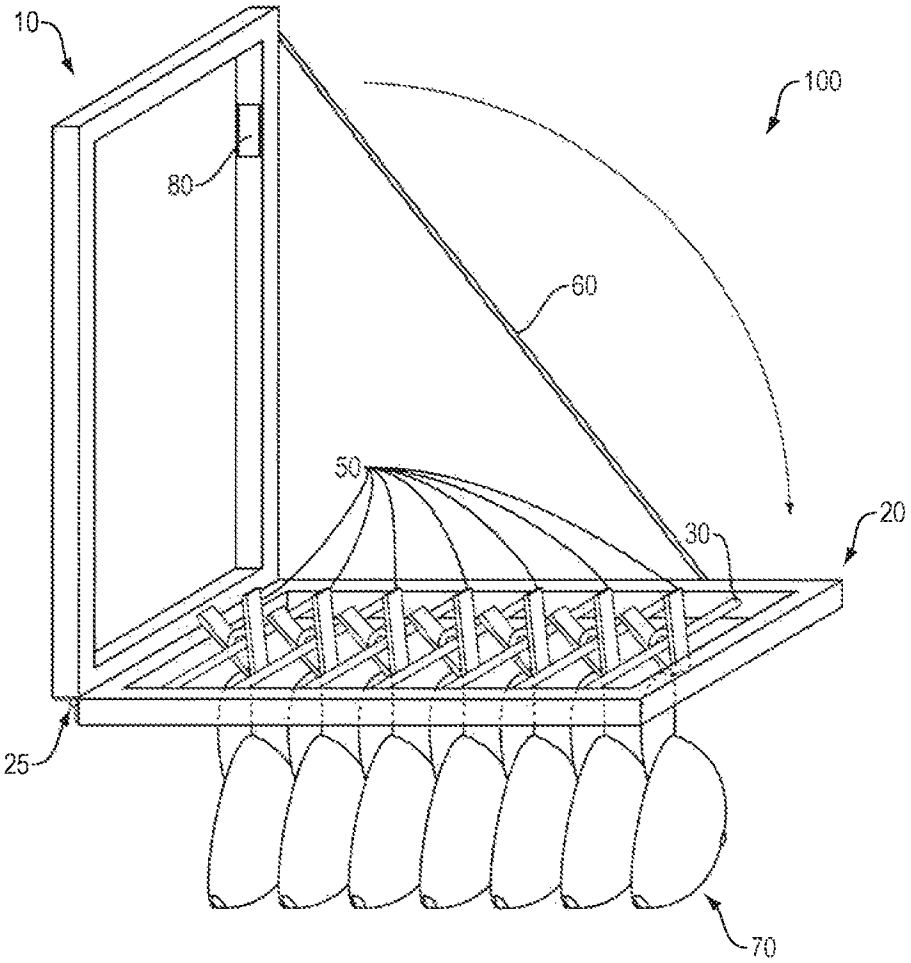
FIG. 1 is a perspective collapsed view of the collapsible hat rack in accordance with an exemplary embodiment of the present invention.

FIG. 1 is a perspective collapsed view of the collapsible hat rack 100 in accordance with an exemplary embodiment of the present invention. As illustrated in FIG. 1, the base unit 10 is mounted vertically on a structure such as a wall. The wall may be any structure capable of fixedly supporting the base unit 10. The base unit may be secured to the wall by, for example, screws or a hanging mechanism.

As can be seen from FIG. 1, the base unit 10 is provided in the exemplary embodiment of the present invention as a rectangular frame wherein the structural components of the base unit 10 are formed around the outer perimeter of the base unit 10 and the center of the base unit 10 is hollow. However, in alternative embodiments of the present invention the base unit 10 may be solid slab or board formed, for example, in the same rectangular shape, although, the illustrative embodiment of the present invention is not limited as such.

The base unit 10 may be made up of four sides (side structures) in some exemplary embodiments of the present invention, but the present invention is not limited as such. For instance the base unit 10 may be made up of a top, and two side structures, with a bottom portion omitted. A pivotable frame 20 may be hingedly attached to the bottom portion of the base unit 10. As can be seen from FIG. 2, the pivotable frame 20 is configured to be rotated about an axis 25 at the bottom of the base unit 10. For example, the pivotable frame 20 may be attached to the base unit via a pin (wherein the pivotable frame rotates around the pin) or a hinge.

The pivotable frame 20 may be, in some embodiments, a size and shape corresponding to the base unit 10 so that when the pivotable frame 20 is rotated to a collapsed position (i.e., a position parallel to the base unit 10), the pivotable frame 20 lays aligned with an outer surface of the base unit 10. That is, the base unit 10, attached to the wall, may be configured so that when the collapsible hat rack is in a closed position, the pivotable frame 20 and the base unit 10 are parallel to each other.

Figure 3:
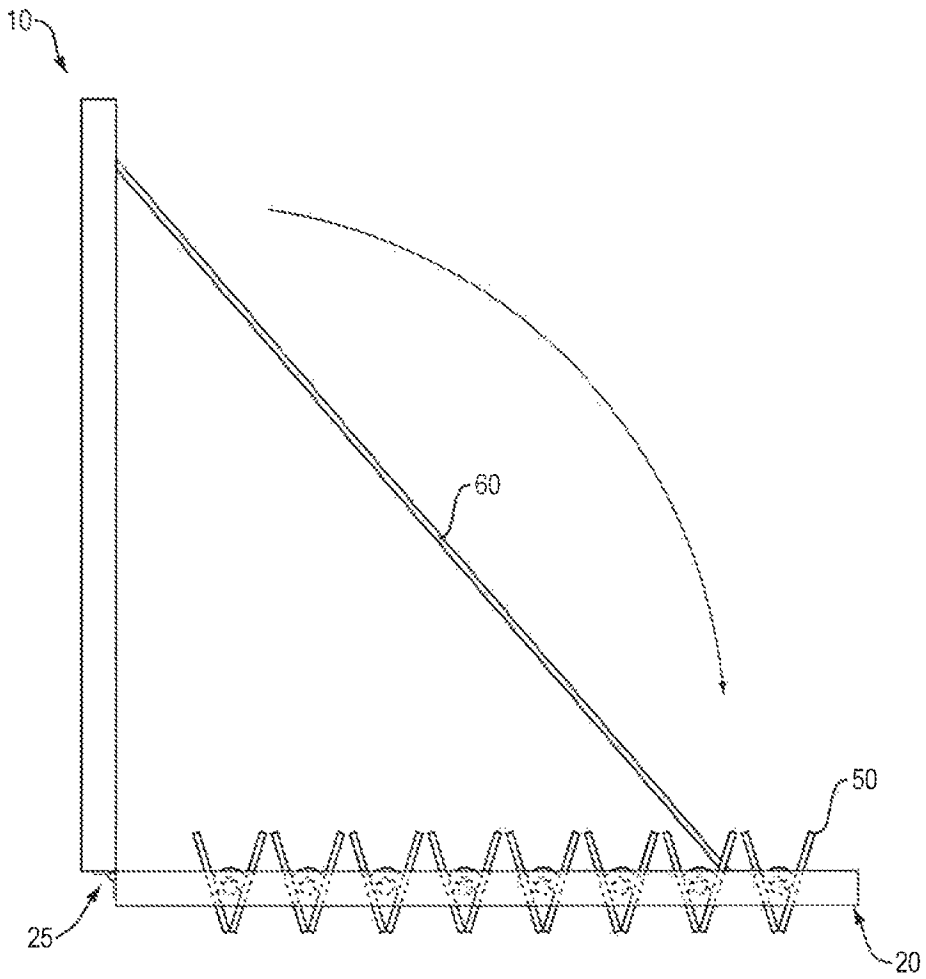
FIG. 3 is a side view of the collapsible hat rack in a fully opened position in accordance with an exemplary embodiment of the present invention.

Alternatively, when the pivotable frame 20 is rotated to a predetermined angle about the axis 25, as shown in FIG. 3, a stopping mechanism 60 may be configured to stop the pivotable frame 20 at said predetermined angle relative to the base unit 10. This stopping mechanism 60 may be for example, an elastic mechanism, such as a spring, string or a hinge. For example, the pivotable frame 20 may be suspended by the stopping mechanism 60 at an angle of 90° from the base unit 10. This stopping mechanism prevents the pivotable frame 20 from being over-extended while at the same time allowing the user to easily chose a hat from the rack. Furthermore, the pivotable frame 20 may be suspended perpendicular to the base unit 10 when fully opened up as can be seen in FIG. 3 so that the user may easily view a plurality of hats stored on the collapsible hat rack 100.

Figure 2:
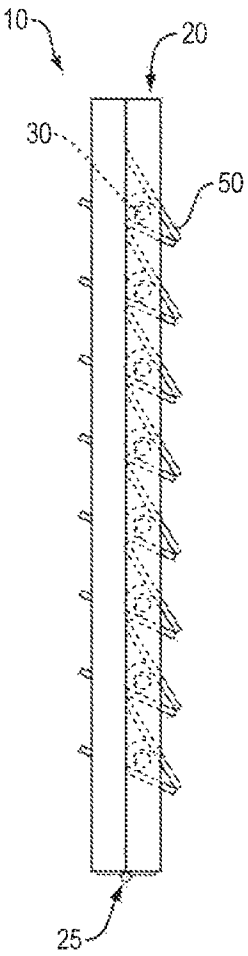
FIG. 2 is a side view of the collapsible hat rack in a fully collapsed position in accordance with an exemplary embodiment of the present invention.

In FIGS. 1 and 2, the stopping mechanism 60 is illustrated as a single cord attached to at least one side of the base unit and at least one side of the pivotable frame. In this illustrative embodiment, the length of the cord is determined based where the pivotable frame should stop in relation to the base unit when the collapsible hat rack 100 is fully opened. However, in alternative embodiments the stopping mechanism may be any device capable of suspending the pivotable frame in mid-air, such as a chain, a spring, lockable hinges, etc. Additionally, more than one stopping mechanism may be installed thereon to further support larger sized collapsible hat racks which may heavier in nature.

The pivotable frame 20 may also include a plurality of rungs 30 traversing the center portion of the pivotable frame 20. The plurality of rungs 20 may be orientated in a direction horizontal to the ground and have a clamping mechanism 50 pivotably attached thereto. The clamping mechanisms 50 preferably pivot about the rungs in the direction of gravity applied due to a mass of a hat clamped between the clamping mechanism 50, or in some cases the clamping mechanisms 50 themselves. The clamping mechanism 50 may be pivotably positioned around the each rung 30 so that the clamping mechanisms 50 pivot in a downward direction when the collapsible hat rack 100 is collapsed and opened accordingly.

Figure 4:
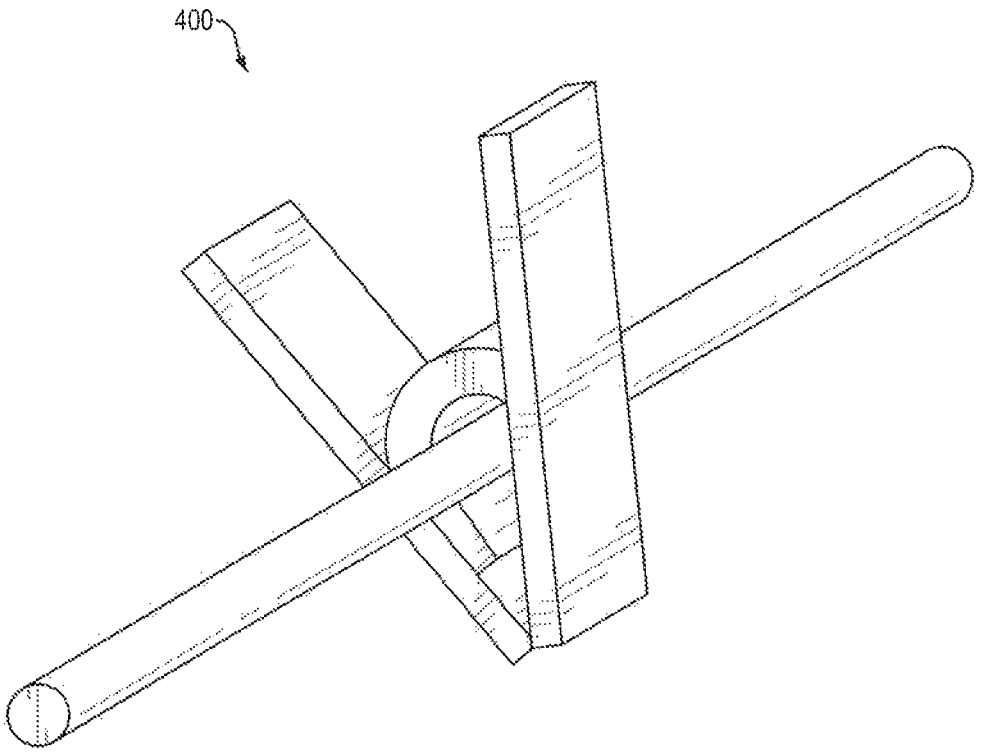
FIG. 4 is a perspective view in an exploded view of an exemplary clamping mechanism movably positioned around a rung in accordance with an exemplary embodiment of the present invention.

FIG. 4 is an exploded perspective view illustrating an exemplary clamping mechanism 400(50) in accordance with an exemplary embodiment of the present invention. In the exemplary embodiment of FIG. 4, the clamping mechanism may be embodied as a squeezable clip 410 configured to open and close when wings 420 of the clip is squeezed together. The clamping mechanisms 410(50) preferably are movably positioned around each of the rungs 30 such that each of the clamping mechanisms may rotate around its associated rung. The squeezable clips 410 may be any squeezable clip that includes, for example, a springing or locking mechanism that is capable of clamping on to an object when pressure is not being applied to, for example in case of squeezable clips 410, wings 420.

Figure 6B:
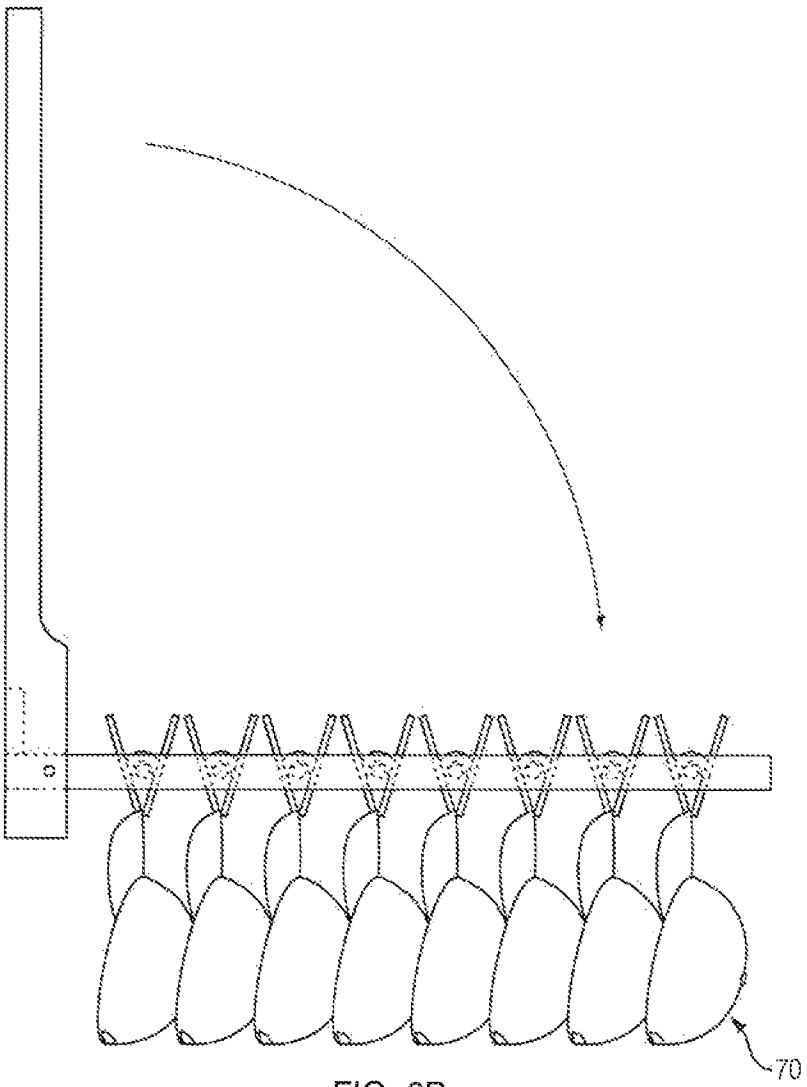
FIG. 6A-B is a perspective view of the collapsible hat rack in an opened and closed position respectively with a plurality of hats attached thereto in accordance with an exemplary embodiment of the present invention.
Figure 6A:
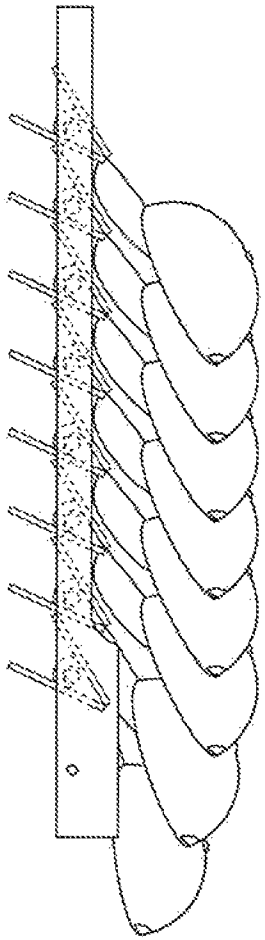

In the illustrative embodiment of the present invention, a plurality of hats may be clamped between each clamping end of each clamping mechanism. Accordingly, when the collapsible hat rack is in the opened position, the hats can be easily seen and identified by the user as shown in FIG. 6A. When the collapsible hat rack is fully collapsed/closed, the hats are rotated in the direction of gravity and efficiently folded together one on top of the other to form a compact row of hats that are neatly folded one on top of the other as shown in FIG. 6B.

Additionally, as a means for securing the collapsible hat rack of the illustrative embodiment of the present invention, a securing mechanism may be applied to one or more of the side portions of the base unit 10 such that the collapsible hat rack 100 stays securely closed when the collapsible hat rack 100 in a closed position. For example, an illustrative embodiment of the present invention may be secured in a closed position via a securing mechanism 80, as shown in FIG. 1. The securing mechanism 80 may be embodied as a magnetic latch, a hook, a clasp, etc. Furthermore, although the securing mechanism is illustrated as being on the inner side of the base unit and the outer side of the pivotable frame (not shown), however, any other location may be feasible as well. Other mechanisms may be used to secure the pivotable frame in the closed position, such as a clasp positioned at the top of the base unit for affixing to a corresponding mechanism on the pivotable frame when in the closed position.

Figure 5:
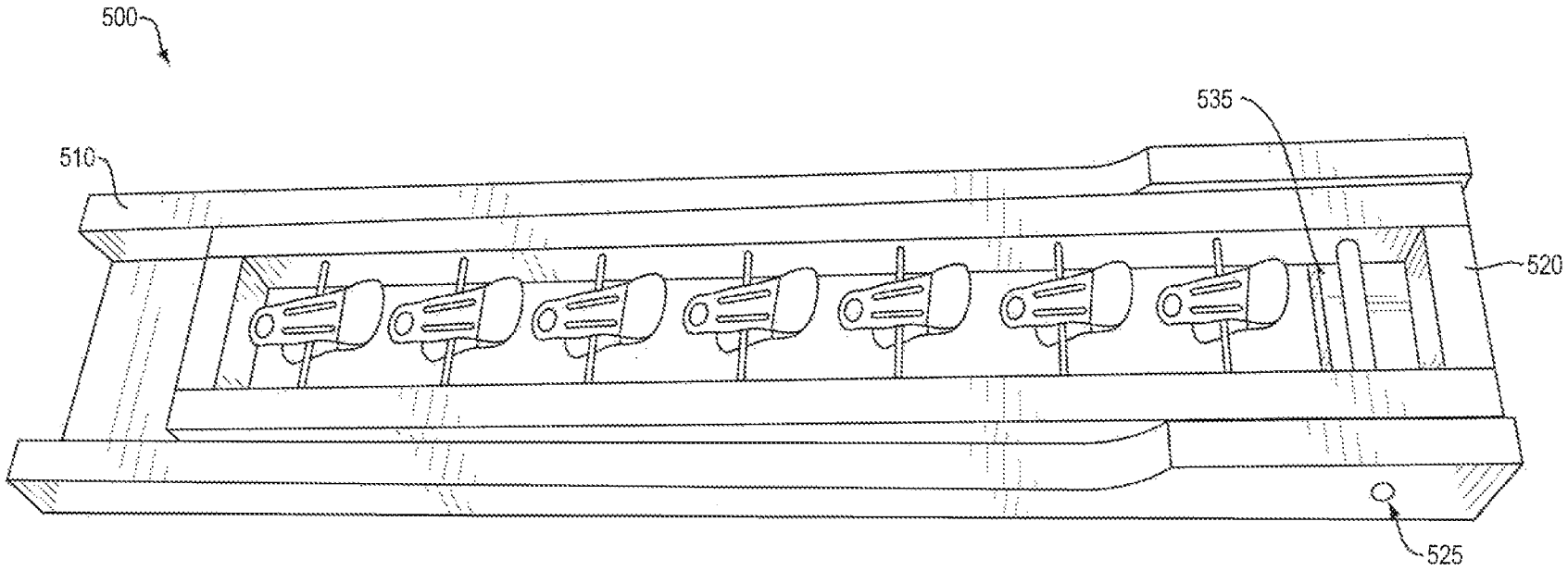
FIG. 5 is a perspective view of an alternative collapsible hat rack in accordance with an exemplary embodiment of the present invention.

Alternatively, as shown in FIG. 5, in some embodiments, a pivotable frame 520 may be configured to fold into a center portion of the base unit 510, by aligning the axis 525 of a pivoting joint between two side portions of the base unit 510. In this embodiment, the base unit 510 and the pivotable frame 520 may be two different sizes. In particular, the base unit 510 may be structured such that an inside width W1 of the base unit 510 is slightly larger than the outer width W2 of the pivotable frame 520 so that when the collapsible hat rack 500 is completely collapsed, the pivotable frame 520 folds into the base unit 510, as shown in FIG. 5. Furthermore, as can be seen in FIG. 5, the side portions of the base unit 510 may have a non-uniform width with a larger width at the bottom of the base unit 510 than at the top of the base unit 510.

Alternatively, different mechanisms for stopping and holding the pivotable frame may be used, such as a board 535 positioned between the side portions of said base unit, as can be seen in FIG. 5. The pivotable frame may also be spring loaded and latched in the open position. The rungs of the collapsible hat rack may also be sufficiently wide such that a plurality of clamping mechanisms may be pivotably attached to the same rung such that a plurality of hats may be held on each rung. Additional side portions of said pivotable frame and additional rungs may also be included such that a plurality of hats may be held on each row comprising multiple rungs.

The base unit, pivotable frame and rungs are preferably made of a hard material, such as wood or metal, and held together as a unified assembly with any one of a plurality of different securing mechanisms known to those skilled in the art, such as pins, screws, nails, adhesives, etc. Additionally, although a preferred embodiment is envisioned as being made of wood or metal, the base unit, pivotable frame and rungs may be made of any material capable of holding the above described shape and structure, such as aluminum, stainless steel, plastic, etc. Accordingly, the illustrative embodiment of the present invention is not limited to wood or metal per se.

Advantageously, the illustrative embodiment of the present invention provides a collapsible hat rack which is able to efficiently and neatly store a plurality of hats in a confined space, for example, on a wall or door. In particular, a plurality of hats may be clamped between each clamping end of each clamping mechanism so that when the collapsible hat rack of the exemplary embodiment of the present invention is in the opened position, the hats can be easily seen and identified by the user. However, when the collapsible hat rack is fully collapsed, the hats are rotated in the direction of gravity and efficiently folded together one on top of the other to form a compact row of hats that are neatly folded one on top of the other.

Thus, the illustrative embodiment allows individuals to maximize floor space while at the same time de-cluttering a storage area, such as a closet, wall space, or shelf. Furthermore, the illustrative embodiment of the present invention is preferably for use with brimmed hats but is not necessarily limited thereto.

The foregoing description of preferred embodiments of the present invention has been presented for the purposes of illustration and description. It is not intended to be exhaustive or to limit the invention to the precise form disclosed. Modifications and variations are possible in light of the above teachings, or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

The invention claimed is:

1. A collapsible hat rack comprising:

a base unit mountable on a surface;

a pivotable frame hingedly mounted to a bottom portion of the base unit, the pivotable frame being defined with side portions arranged at opposite sides of the pivotable frame;

a plurality of rungs fixedly mounted between the side portions of the pivotable frame, each of the plurality of rungs being disposed in a center portion between the side portions of the pivotable frame, wherein pivotable clamping mechanisms are pivotably attached to said rungs, respectively, the clamping mechanisms each configured to clamp on to a hat; and a stopping mechanism configured to suspend the pivotable frame at a predetermined angle from the base unit when the pivotable frame is rotated away from the base unit, wherein the pivotable frame is rotatable relative to the base unit between an opened position and a closed position such that during rotation of the pivotable frame between the opened position and the closed position and when the collapsible hat rack is fully closed, the clamping mechanisms are configured to pivot so as to fold together the hats in an overlapping manner, wherein the clamping mechanisms are movable relative to said rungs, and wherein only a single one of the clamping mechanisms is positioned on each of the plurality of rungs and centered on the respective rung such that in the closed position, the hats are configured to be held only by the clamping mechanisms and folded together in a single row such that the hats are nested together.

2. The collapsible hat rack of claim 1, wherein each of the clamping mechanisms is pivotable based on a direction of gravitational pull.

3. The collapsible hat rack of claim 1, wherein the stopping mechanism is one or more cords attached to at least one side of the base unit and at least one side of the pivotable frame, wherein a length of the cord is determined based on where the pivotable frame should stop in relation to the base unit.

4. The collapsible hat rack of claim 1, wherein the collapsible hat rack may be opened by pulling a top portion of the pivotable frame away from the base unit and rotating the bottom portion of the pivotable frame around an axis at a bottom portion of the base unit until the pivotable frame reaches an angle perpendicular to the base unit.

5. The collapsible hat rack of claim 1, wherein the predetermined angle is a 90° angle relative to the base unit.

6. The collapsible hat rack of claim 4, wherein the collapsible hat rack may be secured in the closed position by a securing mechanism.

7. The collapsible hat rack of claim 6, wherein the securing mechanism is a magnetic latch.

8. The collapsible hat rack of claim 1, wherein said base unit is the same size and shape as the pivotable frame so that when the collapsible hat rack is in the closed position, the pivotable frame and the base unit are parallel to each other.

9. The collapsible hat rack of claim 1, wherein said base unit is a solid board that is the same size and shape as the pivotable frame so that when the collapsible hat rack is in the closed position, the pivotable frame and the base unit are parallel to each other.

10. The collapsible hat rack of claim 1, wherein the plurality of rungs are disposed in the center portion of the pivotable frame parallel to a pivotable axis of the frame.

11. The collapsible hat rack of claim 1, wherein each of the clamping mechanisms is a squeezable clip configured to open and close when ends of said squeezable clip is squeezed together.

12. The collapsible hat rack of claim 1, wherein the pivotable frame, in the closed position, folds into a center portion of the base unit.

13. The collapsible hat rack of claim 1, wherein the base unit is attachable to a surface such as a wall or a door.

14. The collapsible hat rack of claim 1, wherein the base unit, pivotable frame and rungs are made of wood or metal.

15. The collapsible hat rack of claim 1, wherein the base unit, pivotable frame and rungs are made of plastic.

16. The collapsible hat rack of claim 1, wherein the stopping mechanism comprises a board positioned between the side portions of said base unit.

17. The collapsible hat rack of claim 1, wherein the pivotable frame is attached to the base unit via a hinge.

18. The collapsible hat rack of claim 1, wherein the pivotable frame is attached to the base unit via a pin, wherein the pivotable frame rotates around the pin.

19. The collapsible hat rack of claim 1, wherein the pivotable frame is attached to the base unit by an elastic mechanism.

20. A method of storing hats comprising storing said hats on the collapsible hat rack of claim 1.

* * * * *